US008376774B2

(12) United States Patent
Bowman et al.

(10) Patent No.: US 8,376,774 B2
(45) **Date of Patent: *Feb. 19, 2013**

(54) POWER EXTRACTING DEVICE AND METHOD OF USE THEREOF

(75) Inventors: Robert Bowman, Fairport, NY (US); Jean-Jacques Delisle, Theodore, AL (US)

(73) Assignee: Rochester Institute of Technology, Rochester, NY (US)

( * ) Notice: Subject to any disclaimer, the term of this patent is extended or adjusted under 35 U.S.C. 154(b) by 136 days.

This patent is subject to a terminal disclaimer.

(21) Appl. No.: 12/965,961

(22) Filed: Dec. 13, 2010

(65) Prior Publication Data

US 2011/0080057 A1 Apr. 7, 2011

Related U.S. Application Data

(63) Continuation-in-part of application No. 12/960,592, filed on Dec. 6, 2010, and a continuation-in-part of application No. 12/271,999, filed on Nov. 17, 2008, now Pat. No. 7,850,482.

(51) Int. Cl.
*H01R 3/00* (2006.01)

(52) U.S. Cl. ..... 439/489; 439/620.03; 439/913

(58) Field of Classification Search ..... 439/489, 439/578, 913, 620.03; 340/635, 656, 687
See application file for complete search history.

(56) References Cited

U.S. PATENT DOCUMENTS

| | | | |
|---|---|---|---|
| 2,640,118 | A | 5/1953 | Werner |
| 3,196,424 | A | 7/1965 | Hardesty et al. |
| 3,388,590 | A | 6/1968 | Bond |
| 3,396,339 | A | 8/1968 | Miram |
| 3,524,133 | A | 8/1970 | Arndt |
| 3,657,650 | A | 4/1972 | Arndt |
| 3,686,623 | A | 8/1972 | Nijman |
| 3,768,089 | A | 10/1973 | Costanzo |
| 3,808,580 | A | 4/1974 | Johnson |
| 3,945,704 | A | 3/1976 | Kraus et al. |
| 3,960,428 | A | 6/1976 | Naus et al. |
| 3,961,330 | A | 6/1976 | Davis |
| 4,034,289 | A | 7/1977 | Rozylowicz et al. |
| 4,084,875 | A | 4/1978 | Yamamoto |
| 4,240,445 | A | 12/1980 | Iskander et al. |
| 4,421,377 | A | 12/1983 | Spinner |
| 4,489,419 | A | 12/1984 | Wang |

(Continued)

FOREIGN PATENT DOCUMENTS

EP 0527599 A1 2/1993

OTHER PUBLICATIONS

U.S. Appl. No. 12/271,999, filed Nov. 17, 2008. Customer No. 5417.

(Continued)

*Primary Examiner* — Neil Abrams
(74) *Attorney, Agent, or Firm* — Schmeiser, Olsen & Watts, LLP

(57) ABSTRACT

A structure is provided. The structure includes a signal retrieval circuit formed within a disk located within a coaxial cable connector. The signal retrieval circuit is located in a position that is external to a signal path of an electrical signal flowing through the coaxial cable connector. The signal retrieval circuit is configured to extract an energy signal from the electrical signal flowing through the coaxial cable connector. The energy signal is configured to apply power to an electrical device located within the coaxial cable connector. The structure may additionally form a sensing circuit with a status output component. The sensor circuit may be configured to sense physical parameters such as those related to a condition of the electrical signal flowing through the connector or a presence of moisture within the connector.

30 Claims, 11 Drawing Sheets

U.S. PATENT DOCUMENTS 4,758,459 A 7/1988 Mehta
4,777,381 A 10/1988 Fernandes
4,898,759 A 2/1990 Hoover et al.
4,911,655 A 3/1990 Pinyan et al.
4,915,639 A 4/1990 Cohn et al.
4,927,382 A 5/1990 Huber
5,059,948 A 10/1991 Desmeules
5,076,797 A 12/1991 Moulton
5,169,329 A 12/1992 Taguchi
5,194,016 A 3/1993 Hatagishi et al.
5,217,391 A 6/1993 Fisher, Jr.
5,225,816 A 7/1993 Lebby et al.
5,278,525 A 1/1994 Palinkas
5,278,571 A 1/1994 Helfrick
5,345,520 A 9/1994 Grile
5,355,883 A 10/1994 Ascher
5,462,450 A 10/1995 Kodama
5,490,033 A 2/1996 Cronin
5,491,315 A 2/1996 McMills et al.
5,518,420 A 5/1996 Pitschi
5,561,900 A 10/1996 Hosler, Sr.
5,565,783 A 10/1996 Lau et al.
5,565,784 A 10/1996 DeRenne
5,620,330 A 4/1997 Pizon
5,664,962 A 9/1997 Noda
5,892,430 A 4/1999 Wiesman et al.
5,904,578 A 5/1999 Kubota et al.
5,924,889 A 7/1999 Wang
6,005,484 A * 12/1999 Ko ..... 340/662
6,034,521 A 3/2000 Eckardt
6,041,644 A 3/2000 Harde
6,093,043 A 7/2000 Gray et al.
6,134,774 A 10/2000 Williams et al.
6,193,568 B1 2/2001 Dorr
6,236,551 B1 5/2001 Jones et al.
6,243,654 B1 6/2001 Johnson et al.
6,362,709 B1 3/2002 Paxman et al.
6,414,636 B1 7/2002 Godard et al.
6,490,168 B1 12/2002 Rochowicz et al.
6,549,017 B2 4/2003 Coffeen
6,570,373 B1 5/2003 Viola
6,618,515 B2 9/2003 Kimura et al.
6,646,447 B2 11/2003 Cern et al.
6,650,885 B2 11/2003 Anderson et al.
6,755,681 B2 6/2004 Chen
6,783,389 B1 8/2004 Lee
6,859,029 B2 2/2005 Yamanaka et al.
6,896,541 B2 5/2005 Benson
6,986,665 B2 1/2006 Schauz et al.
7,029,327 B2 4/2006 Devine
7,084,769 B2 8/2006 Bauer et al.
7,094,104 B1 8/2006 Burke et al.
7,105,982 B1 9/2006 Hagood, IV et al.
7,173,343 B2 2/2007 Kugel
7,212,125 B2 5/2007 Shanks et
7,253,602 B2 8/2007 Shvach et al.
7,254,511 B2 8/2007 Niedzwiecki et al.
7,262,626 B2 8/2007 Iwasaki
7,264,493 B2 9/2007 Cooper et al.
7,266,269 B2 9/2007 Koste et al.
7,268,517 B2 9/2007 Rahmel et al.
7,276,267 B2 10/2007 Schauz
7,276,703 B2 10/2007 Berkcan et al.
7,306,489 B2 * 12/2007 Werthman et al. ..... 439/620.01
7,368,827 B2 5/2008 Kulkarni et al.
7,413,353 B2 8/2008 Beer et al.
7,440,253 B2 10/2008 Kauffman
7,472,587 B1 1/2009 Loehndorf et al.
7,479,886 B2 1/2009 Burr
7,482,945 B2 1/2009 Hall
7,507,117 B2 3/2009 Amidon
7,513,795 B1 4/2009 Shaw
7,544,086 B1 6/2009 Wells
7,642,611 B2 1/2010 Tsuji et al.
7,733,236 B2 6/2010 Montena et al.
7,749,022 B2 7/2010 Amidon et al.
7,775,115 B2 8/2010 Theuss et al.
7,850,482 B2 12/2010 Montena et al.
7,909,637 B2 * 3/2011 Montena ..... 439/489
7,930,118 B2 4/2011 Vinden et al.
8,002,592 B2 * 8/2011 Crutcher et al. ..... 439/783
8,092,234 B2 1/2012 Friedhof et al.
8,149,127 B2 4/2012 Montena
2002/0090958 A1 7/2002 Ovard et al.
2003/0096629 A1 5/2003 Elliott et al.
2003/0148660 A1 8/2003 Devine
2004/0232919 A1 11/2004 Lacey
2006/0019540 A1 1/2006 Werthman et al.
2007/0173367 A1 7/2007 Duncan
2008/0258876 A1 10/2008 Overhultz et al.
2009/0022067 A1 1/2009 Gotwals
2009/0096466 A1 4/2009 Delforce et al.
2009/0115427 A1 5/2009 Radtke et al.
2009/0284354 A1 11/2009 Pinkham
2010/0081324 A1 4/2010 Montena
2010/0124838 A1 5/2010 Montena et al.
2010/0124839 A1 5/2010 Montena
2011/0074388 A1 3/2011 Bowman
2011/0077884 A1 3/2011 Bowman
2011/0130034 A1 6/2011 Montena et al.

OTHER PUBLICATIONS

U.S. Appl. No. 12/960,592, filed Dec. 6, 2010. Customer No. 7529.
U.S. Appl. No. 12/960,592, filed Dec. 6, 2010; Confirmation No. 7529.
U.S. Appl. No. 12/961,555, filed Dec. 7, 2010; Confirmation No. 9390.
U.S. Appl. No. 12/966,113, filed Dec. 13, 2010; Confirmation No. 8139.
International Search Report and Written Opinion. PCT/US2010/052861. Date of Mailing: Jun. 24, 2011. 9 pages. Applican's file ref.: ID-1295A-PCT.
Office Action (Mail date Jul. 12, 2012) for U.S. Appl. No. 12/961,555, filed Dec. 7, 2010.
Notice of Allowance (Mail date Jul. 11, 2012) for U.S. Appl. No. 12/960,592, filed Dec. 6, 2010.
Office Action (Mail date Jul. 2, 2012) for U.S. Appl. No. 12/966,113, filed Dec. 13, 2010.

* cited by examiner

POWER EXTRACTING DEVICE AND METHOD OF USE THEREOF

RELATED APPLICATIONS

This application is a continuation-in-part of and claims priority from co-pending U.S. application Ser. No. 12/960,592 filed on Dec. 6, 2010, and entitled EMBEDDED COUPLER DEVICE AND METHOD OF USE THEREOF, which is continuation-in-part of U.S. application Ser. No. 12/271,999 filed Nov. 17, 2008, now U.S. Pat. No. 7,850,482 issued on Dec. 14, 2010, and entitled COAXIAL CONNECTOR WITH INTEGRATED MATING FORCE SENSOR AND METHOD OF USE THEREOF.

FIELD OF TECHNOLOGY

The present invention relates generally to coaxial cable connectors. More particularly, the present invention relates to a coaxial cable connector and related methodology for harvesting power from a radio frequency signal flowing through the coaxial cable connector connected to an RF port.

BACKGROUND

Cable communications have become an increasingly prevalent form of electromagnetic information exchange and coaxial cables are common conduits for transmission of electromagnetic communications. Many communications devices are designed to be connectable to coaxial cables. Accordingly, there are several coaxial cable connectors commonly provided to facilitate connection of coaxial cables to each other and or to various communications devices.

It is important for a coaxial cable connector to facilitate an accurate, durable, and reliable connection so that cable communications may be exchanged properly. Thus, it is often important to ascertain whether a cable connector is properly connected. However, typical means and methods of ascertaining proper connection status are cumbersome and often involve costly procedures involving detection devices remote to the connector or physical, invasive inspection on-site. Hence, there exists a need for a coaxial cable connector that is configured to maintain proper connection performance, by the connector itself sensing the status of various physical parameters related to the connection of the connector, and by communicating the sensed physical parameter status through an output component of the connector. The instant invention addresses the abovementioned deficiencies and provides numerous other advantages.

SUMMARY

The present invention provides an apparatus for use with coaxial cable connections that offers improved reliability.

A first aspect of the present invention provides a structure comprising: a disk structure located within a coaxial cable connector; and a signal retrieval circuit formed within the disk structure, wherein the signal retrieval circuit is located in a position that is external to a signal path of an electrical signal flowing through the coaxial cable connector, wherein the signal retrieval circuit is configured to extract an energy signal from the electrical signal flowing through the coaxial cable connector, and wherein the energy signal is configured to apply power to an electrical device located within the coaxial cable connector.

A second aspect of the present invention provides a structure comprising: a first metallic structure formed within a disk structure, wherein the disk structure is located within a coaxial cable connector, wherein the first metallic structure is located in a position that is external to a signal path of an electrical signal flowing through the coaxial cable connector; and a second metallic structure formed within the disk structure, wherein the second metallic coupler structure is located in a position that is external to the signal path of the electrical signal flowing through the coaxial cable connector, and wherein the first metallic structure in combination with the second metallic structure is configured to extract an energy signal from the electrical signal flowing through the coaxial cable connector, and wherein the energy signal is configured to apply power to an electrical device located within the coaxial cable connector.

A third aspect of the present invention provides a structure comprising: a metallic signal retrieval circuit formed within a disk structure located within a coaxial cable connector, wherein the metallic circuit is located in a position that is external to a signal path of an electrical signal flowing through the coaxial cable connector, wherein the metallic signal retrieval circuit is configured to extract an energy signal from the electrical signal flowing through the coaxial cable connector; and an electrical device mechanically attached to the disk structure, wherein the energy signal is configured to apply power to the electrical device.

A fourth aspect of the present invention provides a method comprising: providing a signal retrieval circuit formed within the disk structure located within a coaxial cable connector, wherein the signal retrieval circuit is located in a position that is external to a signal path of an electrical signal flowing through the coaxial cable connector; extracting, by the signal retrieval circuit, an energy signal from the electrical signal flowing through the coaxial cable connector; and supplying, by the energy signal, power to an electrical device located within the coaxial cable connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION

Figure 1:
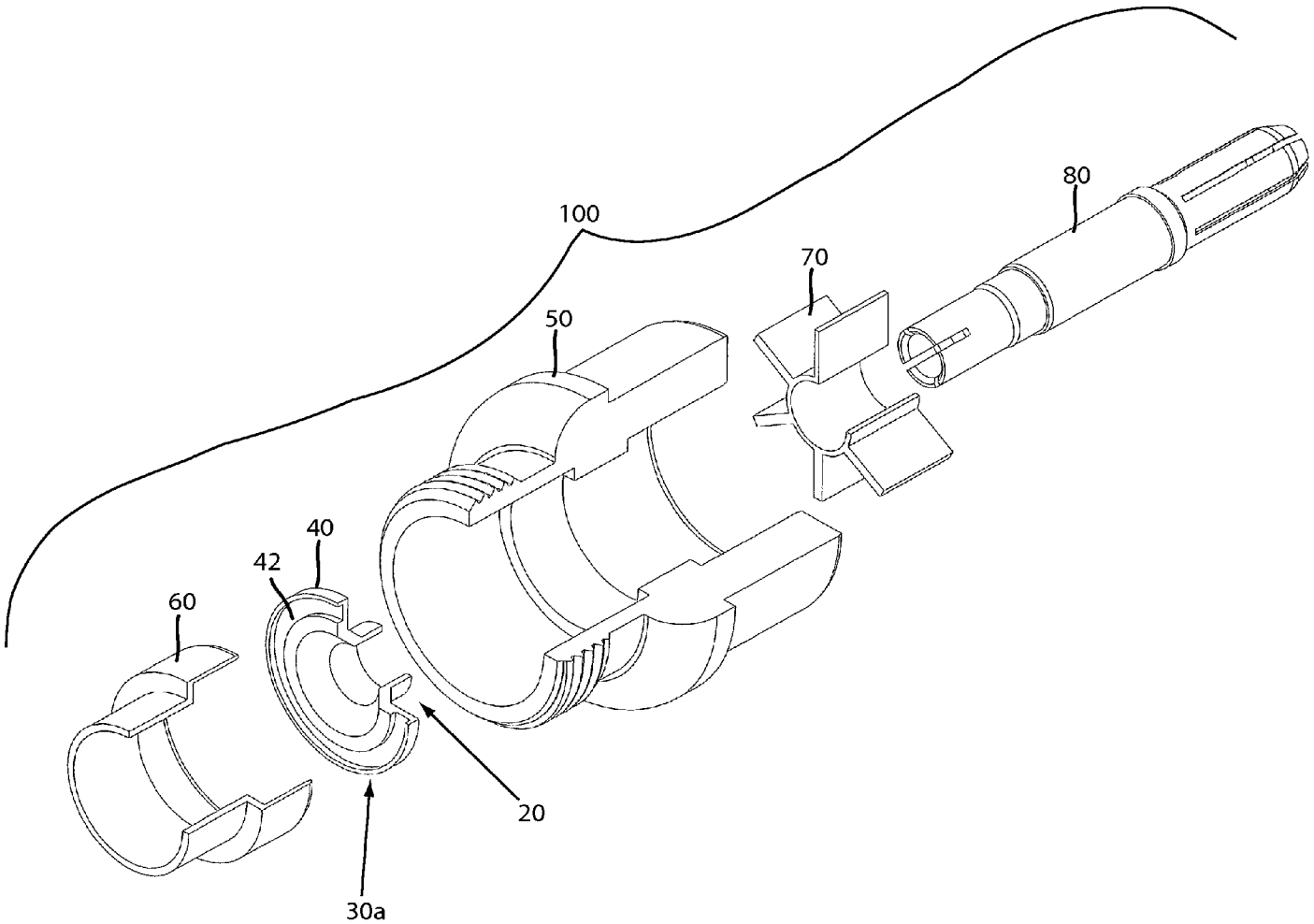
FIG. 1 depicts an exploded cut-away perspective view of an embodiment of a coaxial cable connector with a parameter sensing circuit, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

It is often desirable to ascertain conditions relative to a coaxial cable connector connection or relative to a signal flowing through a coaxial connector. A condition of a connector connection at a given time, or over a given time period, may comprise a physical parameter status relative to a connected coaxial cable connector. A physical parameter status is an ascertainable physical state relative to the connection of the coaxial cable connector, wherein the physical parameter status may be used to help identify whether a connector connection performs accurately. A condition of a signal flowing through a connector at a given time, or over a given time period, may comprise an electrical parameter of a signal flowing through a coaxial cable connector. An electrical parameter may comprise, among other things, an electrical signal (RF) power level, wherein the electrical signal power level may be used for discovering, troubleshooting and eliminating interference issues in a transmission line (e.g., a transmission line used in a cellular telephone system). Embodiments of a connector 100 of the present invention may be considered "smart", in that the connector 100 itself ascertains physical parameter status pertaining to the connection of the connector 100 to an RF port. Additionally, embodiments of a connector 100 of the present invention may be considered "smart", in that the connector 100 itself: detects; measures a parameter of; and harvests power from an electrical signal (e.g., an RF power level) flowing through a coaxial connector.

Figure 2:
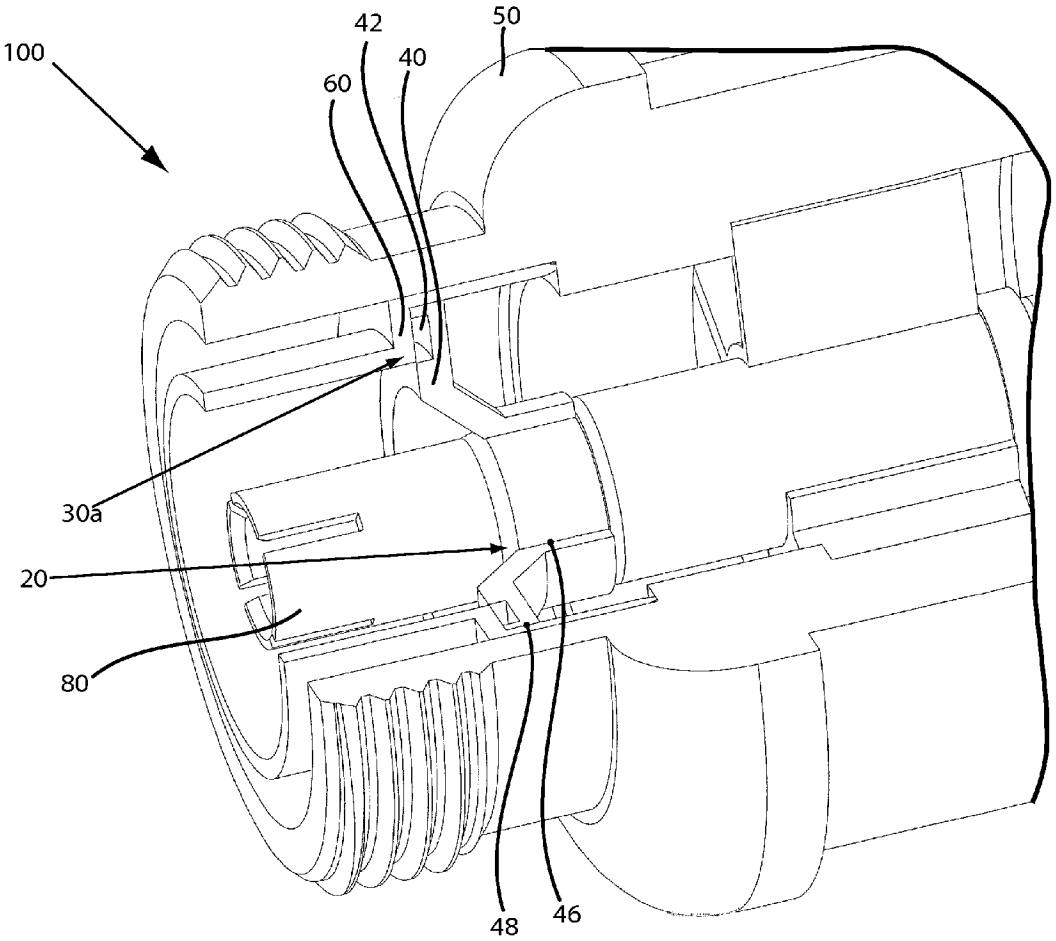
FIG. 2 depicts a close-up cut-away partial perspective view of an embodiment of a coaxial cable connector with a parameter sensing circuit, in accordance with the present invention.
Figure 3:
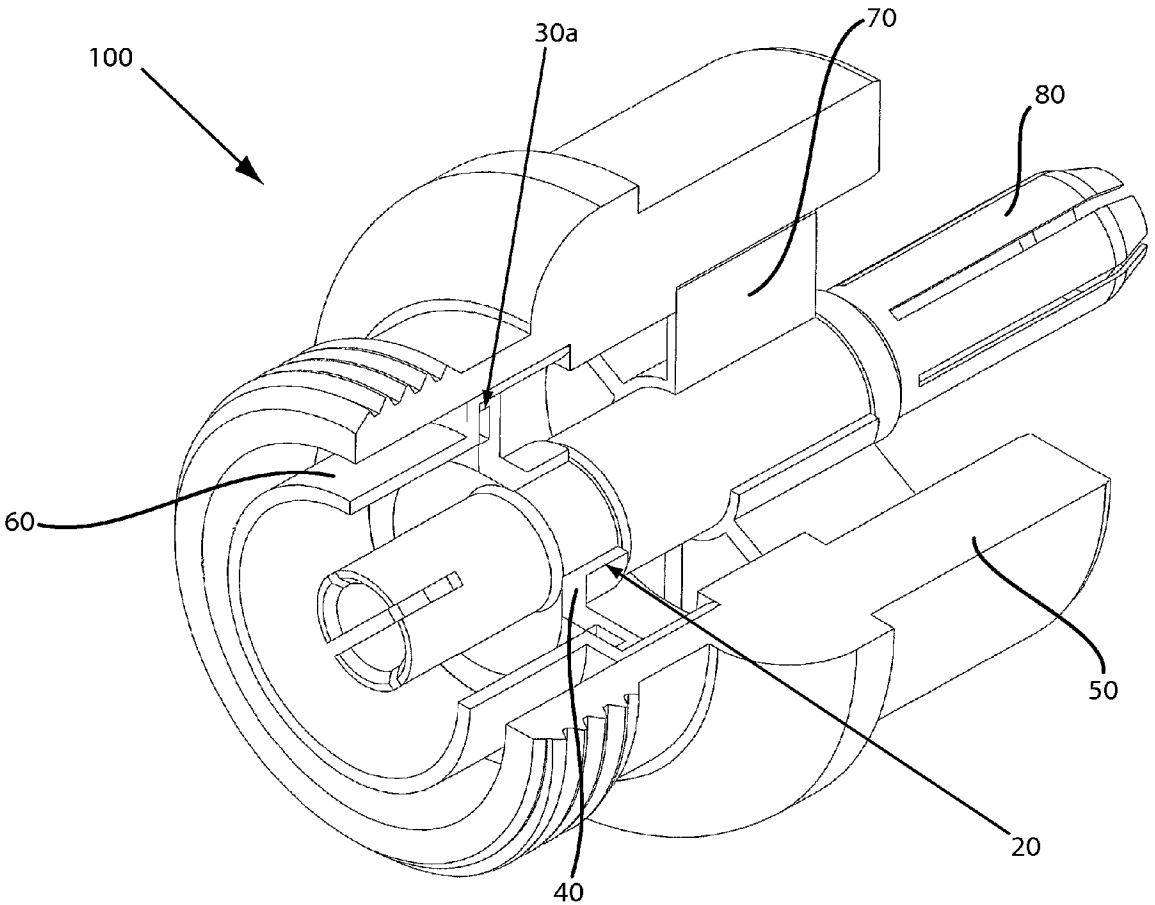
FIG. 3 depicts a cut-away perspective view of an embodiment of an assembled coaxial cable connector with an integrated parameter sensing circuit, in accordance with the present invention.

Referring to the drawings, FIGS. 1-3 depict cut-away perspective views of an embodiment of a coaxial cable connector 100 with an internal power harvesting (and parameter sensing) circuit 30*a*, in accordance with the present invention. The connector 100 includes a connector body 50. The connector body 50 comprises a physical structure that houses at least a portion of any internal components of a coaxial cable connector 100. Accordingly the connector body 50 can accommodate internal positioning of various components, such as a disk structure 40 (e.g., a spacer), an interface sleeve 60, a spacer 70, and/or a center conductor contact 80 that may be assembled within the connector 100. In addition, the connector body 50 may be conductive. The structure of the various component elements included in a connector 100 and the overall structure of the connector 100 may operably vary. However, a governing principle behind the elemental design of all features of a coaxial connector 100 is that the connector 100 should be compatible with common coaxial cable interfaces pertaining to typical coaxial cable communications devices. Accordingly, the structure related to the embodiments of coaxial cable connectors 100 depicted in the various FIGS. 1-11 is intended to be exemplary. Those in the art should appreciate that a connector 100 may include any operable structural design allowing the connector 100 to harvest power from a signal flowing through the connector 100, sense a condition of a connection of the connector 100 with an interface to an RF port of a common coaxial cable communications device, and report a corresponding connection performance status to a location outside of the connector 100. Additionally, connector 100 may include any operable structural design allowing the connector 100 to harvest power from, sense, detect, measure, and report a parameter of an electrical signal flowing through connector 100.

A coaxial cable connector 100 has internal circuitry that may harvest power, sense connection conditions, store data, and/or determine monitorable variables of physical parameter status such as presence of moisture (humidity detection, as by mechanical, electrical, or chemical means), connection tightness (applied mating force existent between mated components), temperature, pressure, amperage, voltage, signal level, signal frequency, impedance, return path activity, connection location (as to where along a particular signal path a connector 100 is connected), service type, installation date, previous service call date, serial number, etc. A connector 100 includes the power harvesting (and parameter sensing) circuit 30*a*. The power harvesting (and parameter sensing) circuit 30*a* may include an embedded coupler device 515*a* and a processing circuit 504*a* that includes, an impedance matching circuit 511, an RF power monitor circuit 502, a RF power harvesting circuit 529, and a telemetry circuit 503 as illustrated and described with respect to FIGS. 4 and 5. The power harvesting (and parameter sensing) circuit 30*a* may be integrated onto or within typical coaxial cable connector components. The power harvesting (and parameter sensing) circuit 30*a* may be located on/within existing connector structures. For example, a connector 100 may include a component such as a disk structure 40 having a face 42. The power harvesting (and parameter sensing) circuit 30*a* may be positioned on and/or within the face 42 of the disk structure 40 of the connector 100. The power harvesting (and parameter sensing) circuit 30*a* is configured to harvest power form an R/F signal flowing through the connector 100. The power connector 100 when the connector 100 is connected with an interface of a common coaxial cable communications device, such as interface port 15 of receiving box. Moreover, various portions of the circuitry of the power harvesting (and parameter sensing) circuit 30*a* may be fixed onto multiple component elements of a connector 100.

Power for power harvesting (and parameter sensing) circuit 30*a* (e.g., the processing circuit 504*a*) and/or other powered components of a connector 100 may be provided through retrieving energy from an R/F signal flowing through the center conductor 80. For instance, traces may be printed on and/or within the disk structure 40 and positioned so that the traces make electrical contact with (i.e., coupled to) the center conductor contact 80 at a location 46 (see FIG. 2). Contact with the center conductor contact 80 at location 46 facilitates the ability for the power harvesting (and parameter sensing) circuit 30*a* to draw power from the cable signal(s) passing through the center conductor contact 80. Traces may also be formed and positioned so as to make contact with grounding components. For example, a ground path may extend through a location 48 between the disk structure 40 and the interface sleeve 60, or any other operably conductive component of the connector 100. Those in the art should appreciate that a power harvesting (and parameter sensing) circuit 30*a* should be powered in a way that does not significantly disrupt or interfere with electromagnetic communications that may be exchanged through the connector 100.

Figure 4:
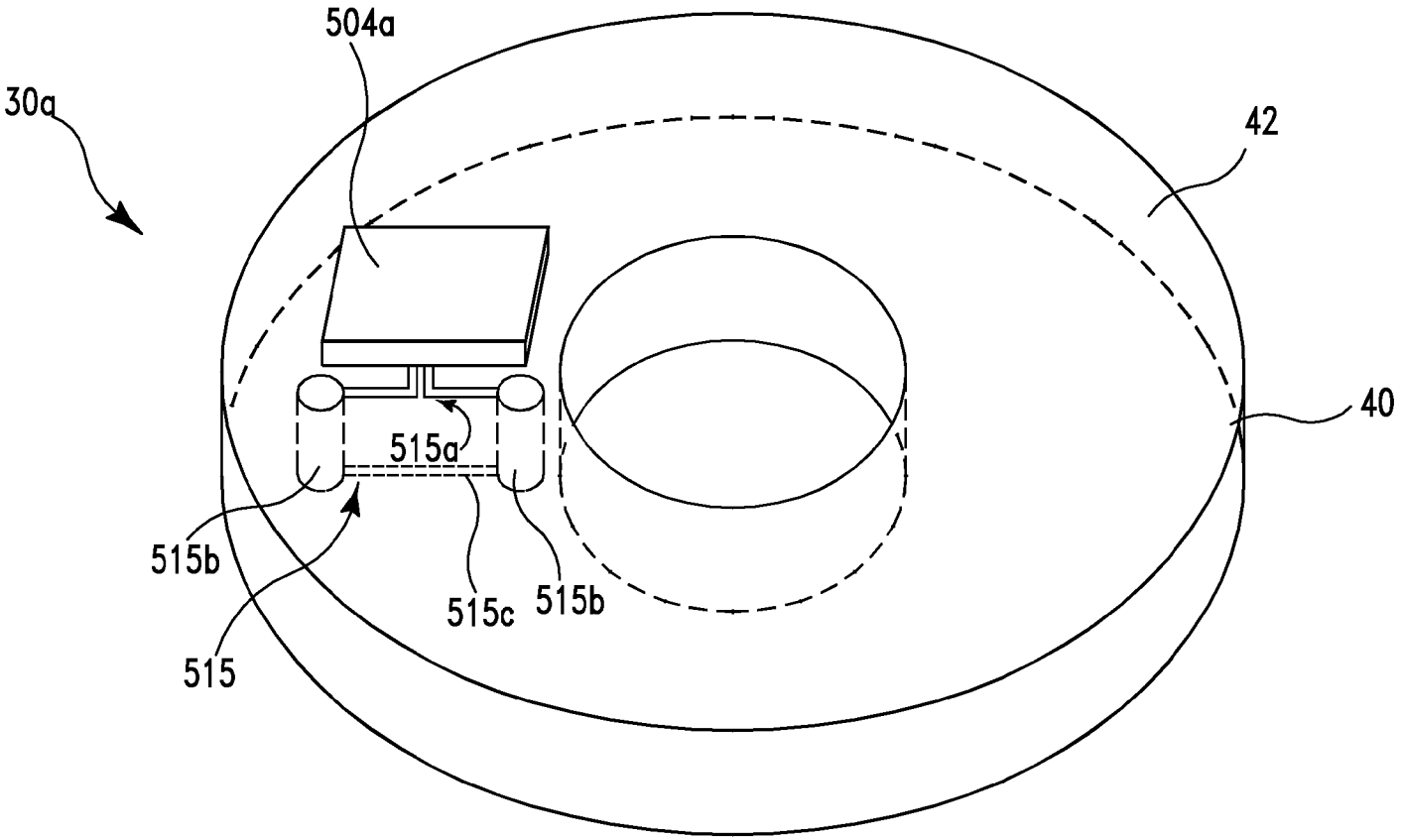
FIG. 4 depicts a perspective view of an embodiment of the disk structure 40 of FIGS. 1-3, in accordance with the present invention.

With continued reference to the drawings, FIG. 4 depicts a perspective view of an embodiment of the disk structure 40 of FIGS. 1-3. The disk structure 40 includes internal power harvesting (and parameter sensing) circuit 30*a*. The power harvesting (and parameter sensing) circuit 30*a* includes an embedded coupler device 515 (including wire traces 515*a*, metallic cylindrical structures 515*b* extending from a bottom surface through a top surface 42 of disk structure 40, and a wire trace 515*c* connecting metallic cylindrical structures 515*b* thereby forming a loop coupler structure) and associated circuitry 504*a* (e.g., including an impedance matching circuit 511, an RF power monitor circuit 502, a R/F power harvesting circuit 529, and a telemetry circuit 503 as schematically illustrated and described with respect to FIG. 5). Although embedded coupler device 515 is illustrated as cylindrical structures extending from a top surface 42 through a bottom surface of disk structure 40, note that embedded coupler device 515 may comprise any geometrical shape (e.g., circular, spherical, cubicle, etc). Embedded coupler device 515 may include a directional coupler and/or a loop coupler that harvests power from a radio frequency (RF) signal being transmitted down a transmission line (and through connector 100 of FIGS. 1-3) and/or optionally extracts a sample of the RF signal. The harvested power may be used to power electronic transducers/sensors for generating data regarding a performance, moisture content, tightness, efficiency, and alarm conditions within the connector 100. Disk structure 40 provides a surface 42 for implementing a directional coupler. FIG. 4 illustrates an embedded directional coupler (i.e., coupler device 515) mounted on/within the disc structure 40 located internal to connector 100. Coupler device 515 harvests energy from an RF signal on the transmission line (e.g., a coaxial cable for an R/F tower). Coupler device 515 additionally provides a real time measurement of RF signal parameters on the transmission line (e.g., a coaxial cable). Disk structure 40 incorporates electronic components (e.g., associated circuitry 504*a* in an integrated circuit such as a signal processor) to harvest the power, condition the sensed parameter signals (i.e., sensed by coupler device 515), and transmit a status of the connector 100 condition over a telemetry system. Signals sensed by the coupler device 515 may include a magnitude of a voltage for forward and reverse propagating RF waveforms present on a coaxial cable center conductor (e.g., center conductor 80 of FIGS. 1-3) relative to ground. A geometry and placement of the coupler device 515 on the disc structure 515 determines a calibrated measurement of RF signal parameters such as, among other things, power and voltage standing wave ratio. Coupler device 515 allows for a measurement of forward and reverse propagating RF signals along a transmission line thereby allowing a measurement of a voltage standing wave ratio and impedance mismatch in a cabling system of the transmission line. The disk structure 40 (including the internal power harvesting (and parameter sensing) circuit 30*a*) may be implemented within systems including coaxial cables and RF connectors used in cellular telephone towers. The disk structure 40 made include syndiotactic polystyrene. An electroplated metallurgy may be used (i.e., on/within the disk structure 40) to form the coupler device 515 and electronic interconnects (e.g., wire traces 515*a*) to the associated circuitry 504*a*. The coupler device 515 may be used in any application internal to a coaxial line to harvest power from RF energy propagating along the center coaxial line. The coupler device 515 may be used to measure directly and in real time, a calibrated sample of forward and reverse voltages of the RF energy. The calibrated sample of the forward and reverse voltages may provide key information regarding the quality of the coaxial cable and connector system. Additionally, a propagated RF signal and key parameters (such as power, voltage standing wave ratio, intersectional cable RF power loss, refection coefficient, insertion loss, etc) may be determined. A coaxial transmission line supports a transmission electron microscopy (TEM) mode electromagnetic wave. TEM mode describes a property of an orthogonal magnetic and electric field for an RF signal. TEM mode allows for an accurate description of the electromagnetic field's frequency behavior. An insertion of an electrically small low coupling magnetic antenna (e.g., coupler device 515) is used to harvest power from RF signals and measure an integrity of passing RF signals (i.e., using the electromagnetic fields' fundamental RF behavior). Coupler device 515 may be designed at a very low coupling efficiency in order to avoid insertion loss. Harvested power may be used to power an on board data acquisition structure (e.g., associated circuitry 504*a*). Sensed RF signal power may be fed to an on board data acquisition structure (e.g., associated circuitry 504*a*). Data gathered by the associated circuitry 504*a* is reported back to a data gathering device (e.g., transmitter 510*a*, receiver 510*b*, or combiner 545 in FIG. 5) through the transmission path (i.e., a coaxial cable) or wirelessly.

Figure 5A:
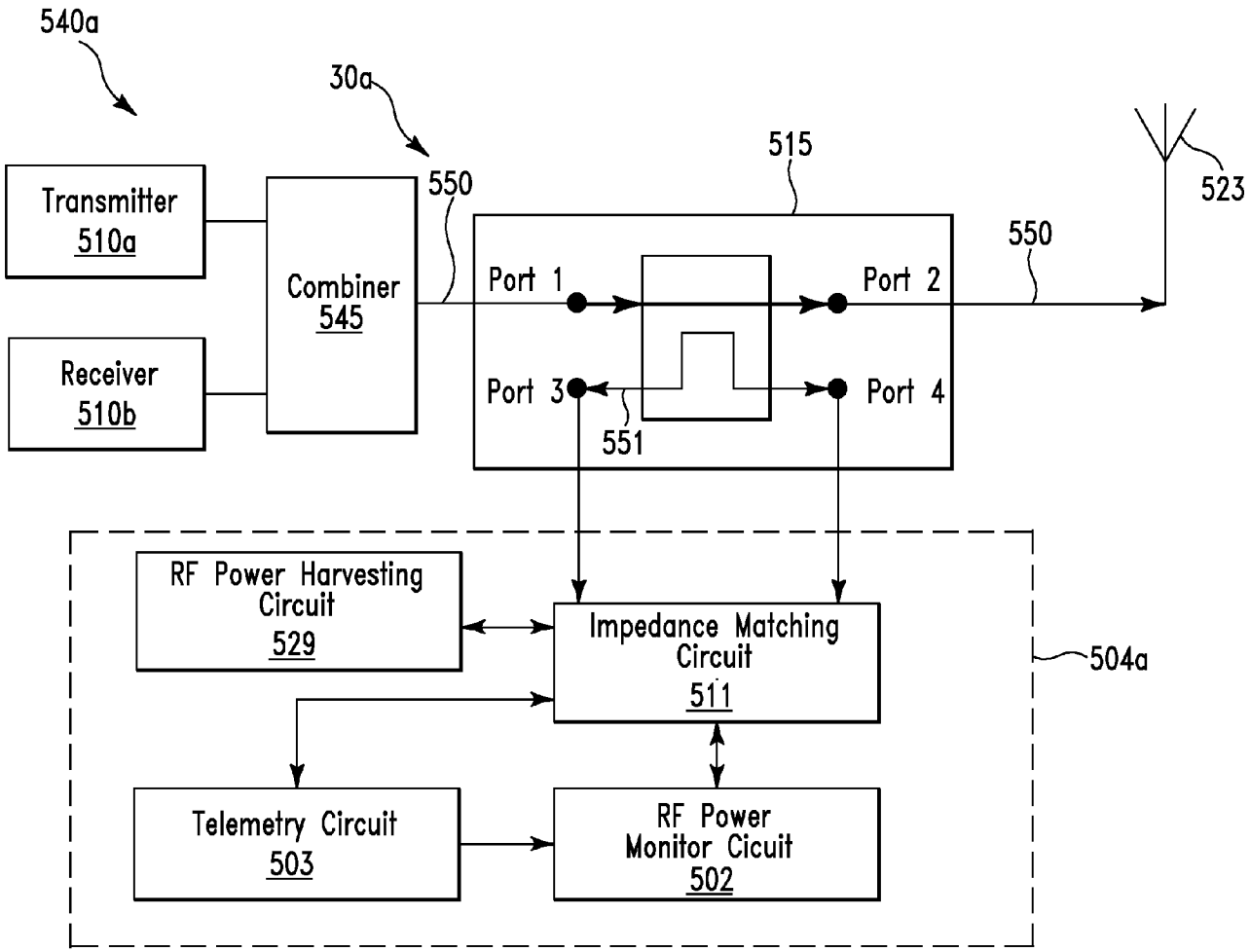
FIG. 5A depicts a schematic block diagram view of an embodiment of a system including the power harvesting and parameter sensing circuit of FIGS. 1-4, in accordance with the present invention.
Figure 5B:
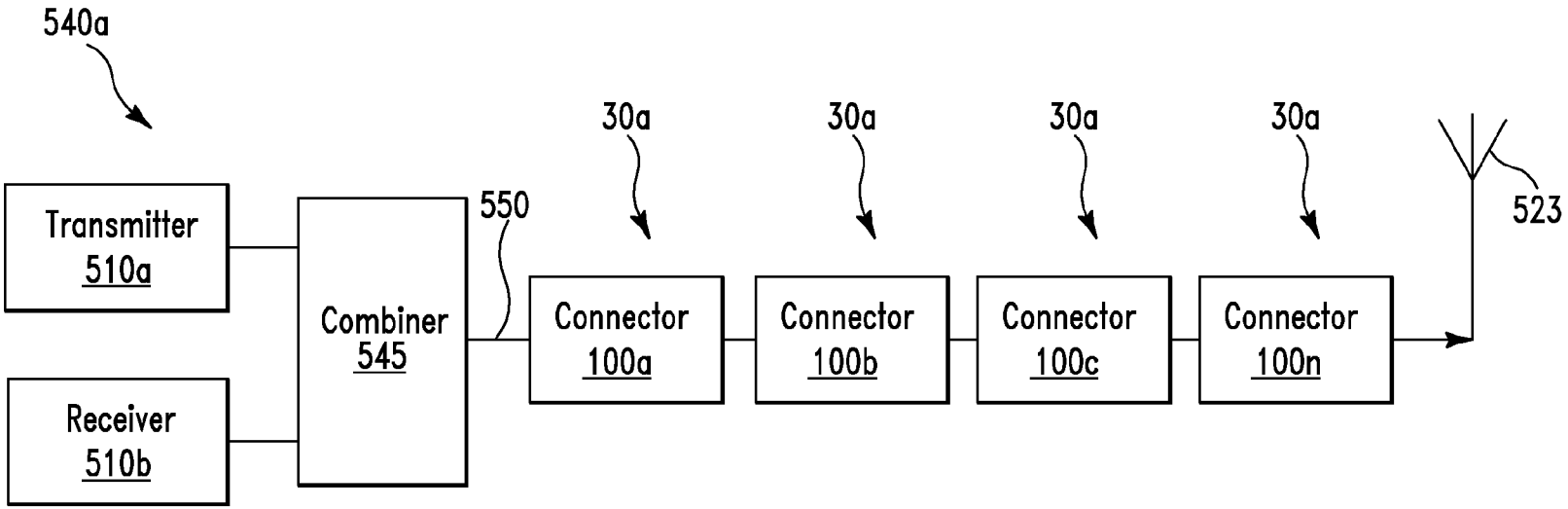
FIG. 5B depicts a schematic block diagram view of an embodiment of a system including multiple power harvesting and parameter sensing circuits, in accordance with the present invention.

FIG. 5A shows schematic block diagram view of an embodiment of a system 540*a* including a power harvesting (and parameter sensing) circuit 30*a* connected between (e.g., via a coaxial cable(s)) an antenna 523 (e.g., on a cellular telephone tower) and a transmitter 510*a* and receiver 510*b* (connected through a combiner 545). Although system 540*a* of FIG. 5A only illustrates one power harvesting (and parameter sensing) circuit 30*a* (within a coaxial cable connector), note that system 540*a* may include multiple power harvesting (and parameter sensing) circuits 30*a* (within multiple coaxial cable connectors) located at any position along a main transmission line 550 (i.e., as illustrated with respect to FIG. 5B). Embodiments of a power harvesting (and parameter sensing) circuit 30*a* may be variably configured to include various electrical components and related circuitry so that a connector 100 can harvest power and measure or determine connection performance by sensing a condition relative to the connection of the connector 100, wherein knowledge of the sensed condition may be provided as physical parameter status information and used to help identify whether the connection performs accurately. Accordingly, the circuit configuration as schematically depicted in FIG. 5 is provided to exemplify one embodiment of a power harvesting (and parameter sensing) circuit 30*a* that may operate with a connector 100. Those in the art should recognize that other power harvesting (and parameter sensing) circuit 30*a* configurations may be provided to accomplish the power harvesting and the sensing of physical parameters corresponding to a connector 100 connection. For instance, each block or portion of the power harvesting (and parameter sensing) circuit 30*a* can be individually implemented as an analog or digital circuit.

As schematically depicted, a power harvesting (and parameter sensing) circuit 30*a* may includes an embedded coupler device 515 (e.g., a directional (loop) coupler as illustrated) and associated circuitry 504*a*. A directional coupler couples energy from main transmission line 550 to a coupled line 551. The associated circuitry 504*a* includes an impedance matching circuit 511, an RF power monitor circuit 502, an RF power harvesting circuit, and a telemetry circuit 503. The transmitter 510*a*, receiver 510*b*, and combiner 545 are connected to the antenna 523 through coupler device 515 (i.e., the transmitter 510*a*, receiver 510*b*, and combiner 545 are connected to port 1 of the coupler device 515 and the antenna is connected to port 2 of the coupler device 515) via a coaxial cable with connectors. Ports 3 and 4 (of the coupler device 515) are connected to an impedance matching circuit 511 in order to create matched terminated line impedance (i.e., optimizes a received RF signal). Impedance matching circuit 511 is connected to RF power monitoring circuit 502 and RF power harvesting circuit 529. The RF power harvesting circuit 529 receives and conditions (e.g., regulates) the harvested power from the coupler device 515. A conditioned power signal (e.g., a regulated voltage generated by the RF power harvesting circuit) is used to power any on board electronics in the connector. The RF power monitoring circuit 502 receives (from the coupler device 515) a calibrated sample of forward and reverse voltages (i.e., from the coaxial cable). A propagated RF signal and key parameters (such as power, voltage standing wave ratio, intersectional cable RF power loss, refection coefficient, insertion loss, etc) may be determined (from the forward and reverse voltages) by the power monitoring circuit 502. The telemetry circuit 503 is connected between the power monitoring circuit 502 and the impedance matching circuit 511. The telemetry circuit 503 provides protocols and drive circuitry to transmit sensor data (i.e., from coupler device 515) back to the coaxial line for transmission to a data retrieval system. The receiver 510*b* may include signal reader circuitry for reading and analyzing a propagated RF signal flowing through main transmission line 550.

FIG. 5B shows schematic block diagram view of an embodiment of system 540*b* of FIG. 5A including multiple sensing/processing circuits 30*b* located in multiple coaxial cable connectors 100*a* . . . 100*n* connected between (e.g., via a coaxial cable(s)) antenna 523 (e.g., on a cellular telephone tower) and transmitter 510*a* and receiver 510*b* (connected through a combiner 545). Each of coaxial cable connectors 100*a* . . . 100*n* (comprising an associated sensing/processing circuit 30*b*) in includes an RF energy sensing/extraction point. The RF energy may be transmitted from an existing RF communication signal or a dedicated RF energy signal dedicated to providing power for each sensing/processing circuit 30*b*.

Figure 6:
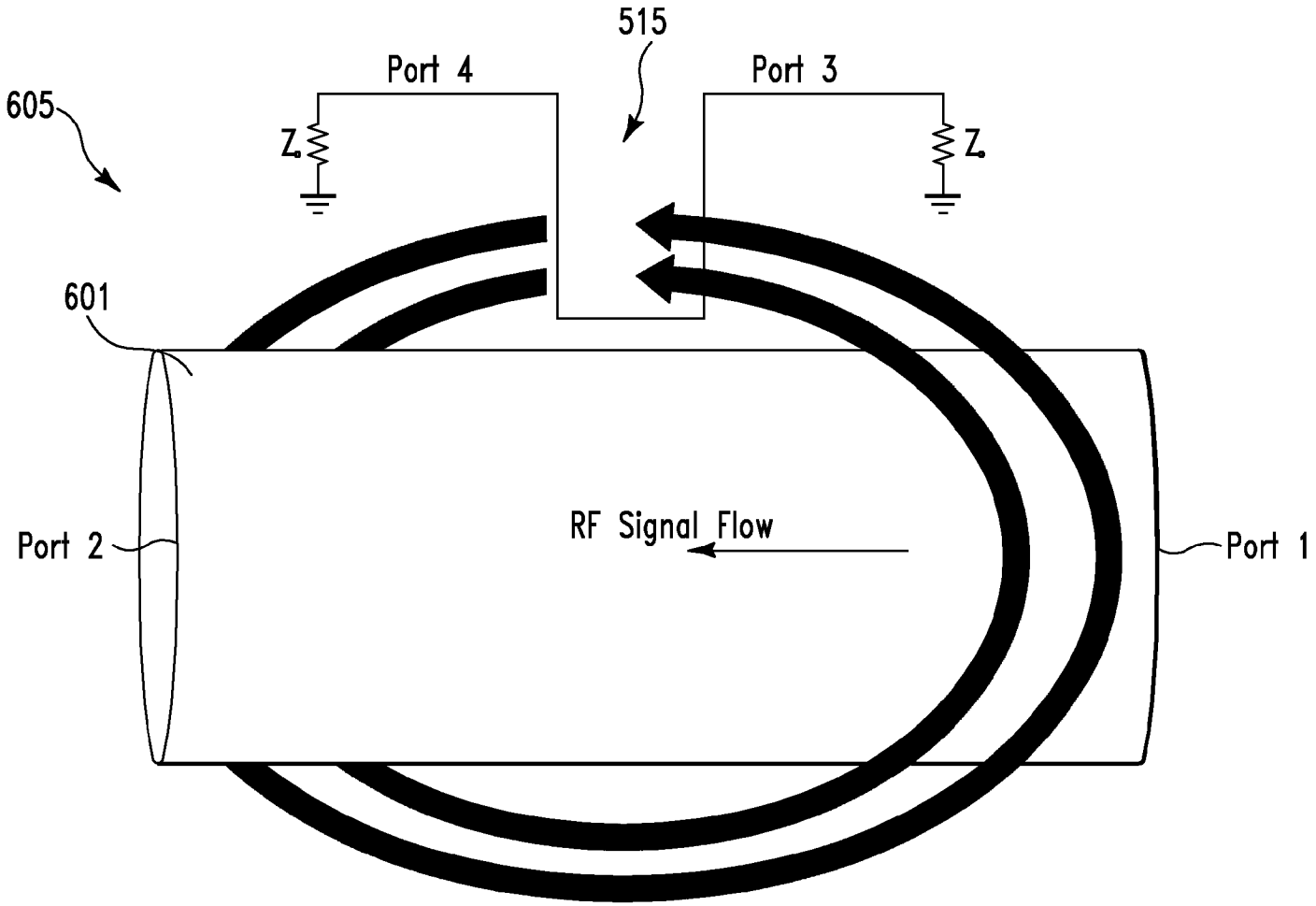
FIG. 6 depicts a perspective view of an embodiment of a loop coupler device, in accordance with the present invention.

FIG. 6 depicts a perspective view of an embodiment of the coupler device 515 (e.g., a loop coupler structure) of FIGS. 1-5. FIG. 6 illustrates a magnetic field 605 established by an AC current through a center conductor 601 (of a coaxial cable) penetrating a suspended loop (e.g., coupler device 515). Coupler device 515 includes a gap between the center conductor 601 and a substrate to avoid a sparking effect between the center conductor 601 and outer shielding that often occurs under surge conditions. An RF signal passing through the center conductor 601 establishes an azimuthally orbiting magnetic field 605 surrounding the center conductor 601. A conductive loop structure (e.g., coupler device 515) that supports a surface that is penetrated by the orbiting magnetic field 605 will induce a current through its windings and induce a voltage (i.e., harvested power) across its terminals dependent upon a termination impedance. The conductive loop structure is constructed to surround an open surface tangent to the azimuthal magnetic field 605 and induce the aforementioned current. End leads of the conductive loop structure emulate a fully connected loop while maintaining electrical separation thereby allowing for a voltage (i.e., for power electronics within the connector 100) to be developed across terminals (ports 3 and 4).

Figure 7A:
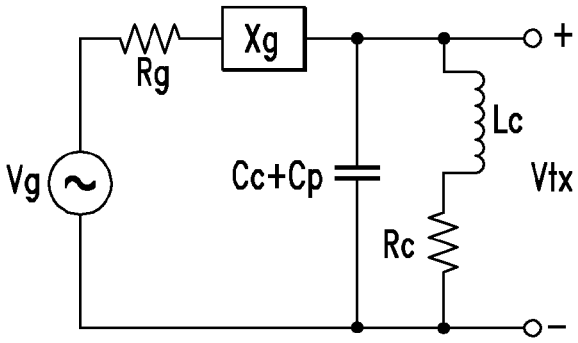
FIGS. 7A-7C depict schematic views of embodiments of the coupler device of FIGS. 1-6, in accordance with the present invention.
Figure 7B:
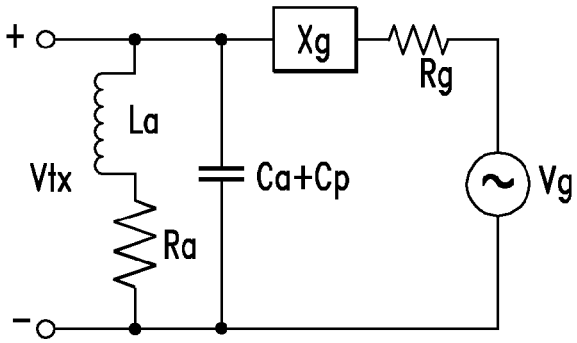
Figure 7C:
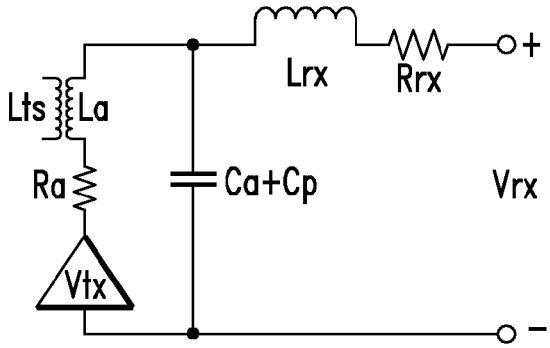

FIGS. 7A-7C depict schematic views of an embodiments of the coupler device 515 (e.g., a loop coupler structure) of FIGS. 1-6. As RF power is passed through a coupling structure (e.g., coupler device 515) and a coaxial line, the coupling structure will transmit a portion of the RF power as electric and magnetic components inside the coaxial structure thereby inducing a current down the center conductor and establishing a TEM wave inside the coaxial structure. The coaxial line will drive the TEM wave through the open space occupied by the coupling structure and will induce fields that will couple energy into the structures. FIGS. 7A-7C depict a TX of power from the coupling structure to a coaxial line and vice versa.

FIG. 7A demonstrates a TX lumped circuit model of a coaxial line. Model parameters including a subscript "g" indicate generator parameters. The generator parameters comprise inductive and resistive Thevenin values at an output of the coupling structure to the coaxial line. Model parameters with a subscript "c" describe inductance, capacitance, and resistance of the coaxial line at the point of the coupling structure's placement. Model parameter Cp comprises a parasitic capacitance with non-coaxial metallic structures and is on the order of pF. Vtx comprises a transmission voltage that induces an electric or magnetic field component that excites the coupling structure. The following equations 1 and 2 define power transfer equations for a generator perturbing the coaxial line. Equation 1 expresses a transmission voltage in terms a generator voltage divided down by transmitter impedances.

$$V_{TX} = \frac{V_G}{Z_G + Z_{Cc//(Lc+Rc)}} \qquad \text{Equation 1}$$

Equation 2 expresses a transmission power in terms of lumped circuit components.

$$P_{TX} = \frac{1}{2}|I_{TX}|^2 R_C = \frac{1}{2}\frac{|V|^2 R_C}{|Z_G + Z_{Cc//(Lc+Rc)}|^2} \qquad \text{Equation 2}$$

FIG. 7B demonstrates RF power transmitted in a TEM wave along a coaxial line's length. The TEM wave is received by the coupling structure and an induced power is brought through the coupling structure to internal electronics. A frequency dependant reception of the RF power is dictated by the particular impedances caused by the inductive coupling between the conductive structures, the capacitive coupling with the grounded metal shielding, and the mixed coupling with the other metallic traces within the coaxial environment.

FIG. 7C demonstrates an Irx current source comprising an induced dependant current that varies with the power and frequency of the transmitted signal along the coaxial line. The La, Ra, and Ca elements are intrinsic and coupling impedances of the loop coupler positioned near the coaxial line. Cp comprises a parasitic capacitance due to a surrounding grounded metal connector housing. The Lrx and Rrx elements comprise impedances used to tune the coupling structure for optimum transmission at select frequencies. Vrx comprises a received voltage to internal electronics. Lts is comprises a mutual inductance created from coupling between the coupling structure and a metallic structure used to tune the coupling structure's resistive impedance at a select power transfer frequency.

Figure 8B:
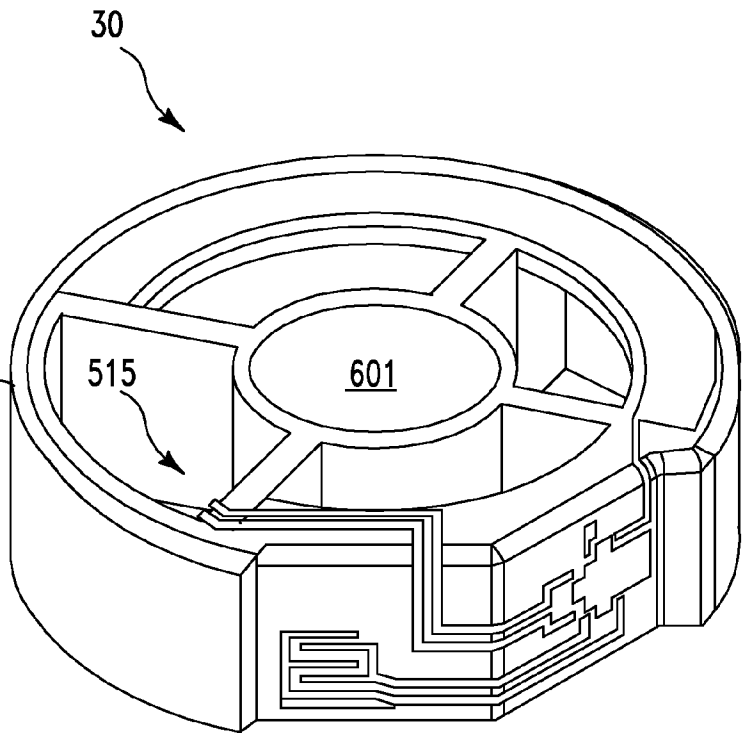
FIGS. 8A and 8B depict perspective views of an embodiment of the disc structure comprising the internal power harvesting and parameter sensing circuit of FIGS. 1-6.
Figure 8A:
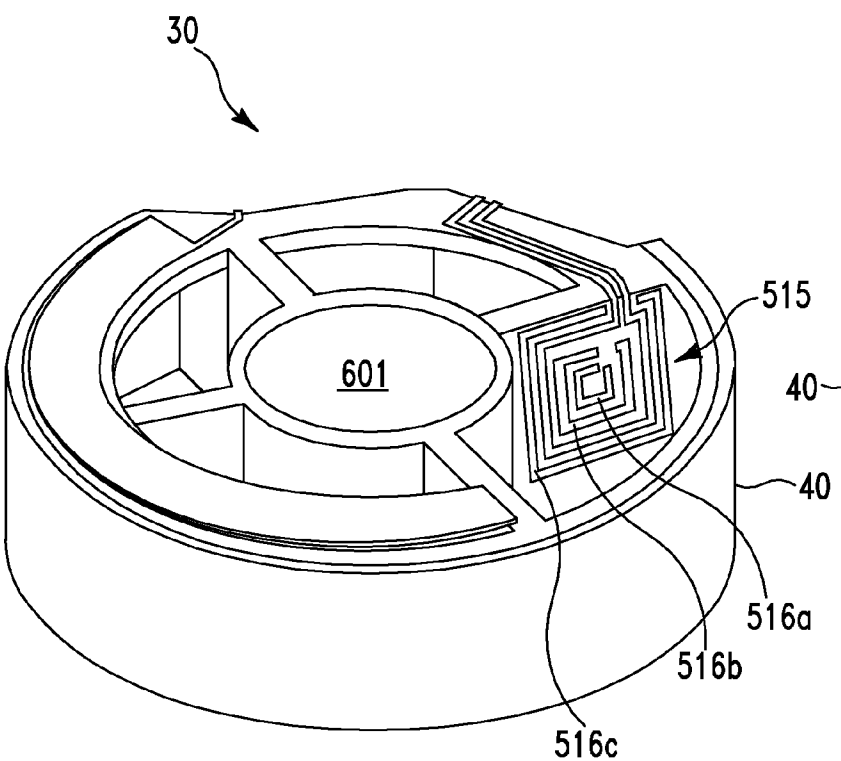

FIGS. 8A and 8B depict perspective views of an embodiment of the disc structure 40 comprising the internal power harvesting (and parameter sensing) circuit 30*a* of FIGS. 1-6. FIGS. 8A and 8B illustrate coupler device 515 mounted to or integrated with disk structure 40. Coupler device 515 illustrated in FIG. 8A comprises a loop coupler that includes optional loops 516*a*, 516*b*, and 516*c* for impedance matching, etc.

Figure 9:
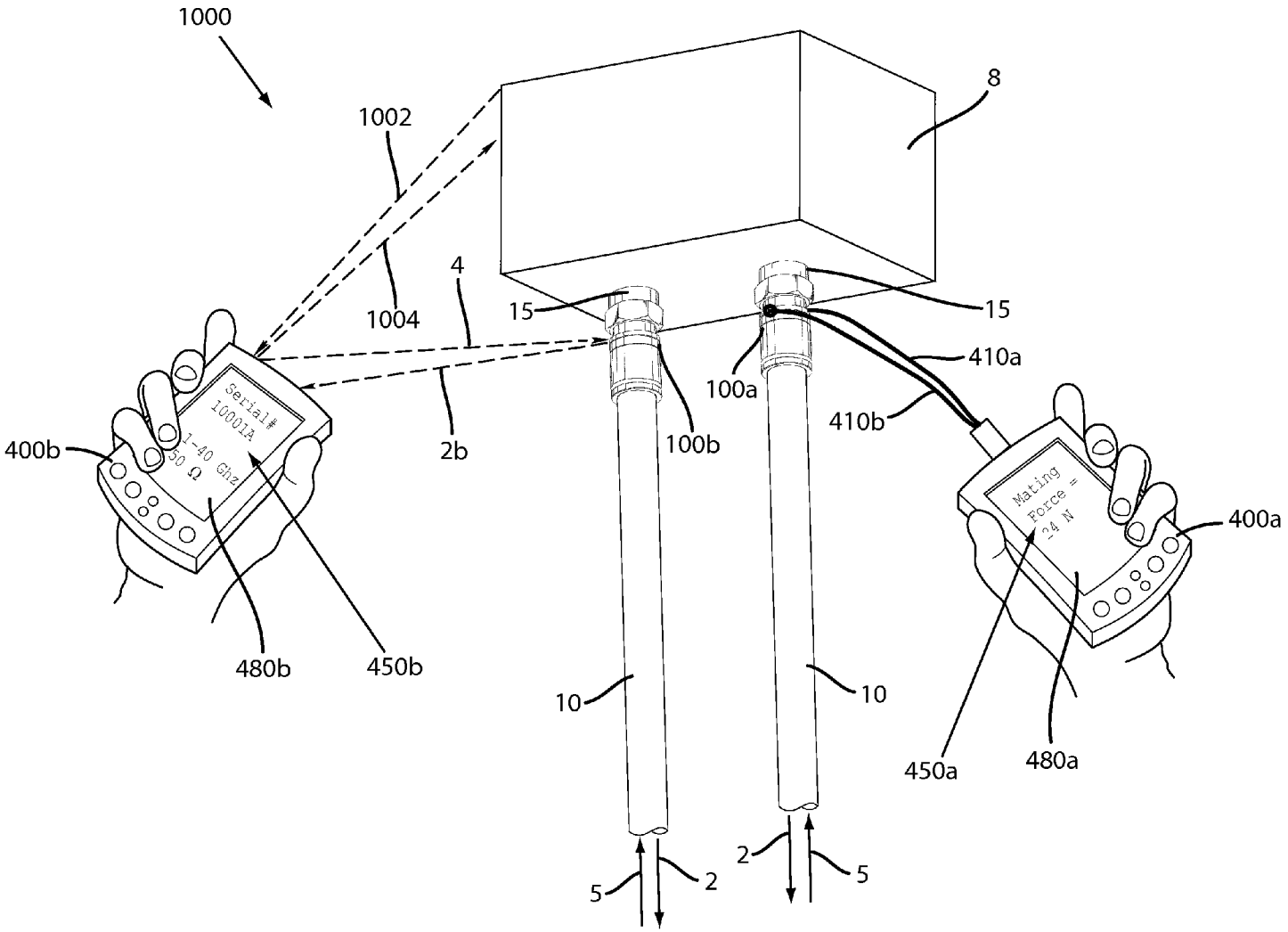
FIG. 9 depicts a perspective view of an embodiment of a physical parameter status/electrical parameter reader, in accordance with the present invention.

Referring further to FIGS. 1-8B and with additional reference to FIG. 9, embodiments of a coaxial cable connection system 1000 may include a physical parameter status/electrical parameter reader 400 (e.g., transmitter 510*a*, receiver 510*b*, and/or any other signal reading device along cable 550 of FIG. 5) located externally to the connector 100. The reader 400 is configured to receive, via a signal processing circuitry (e.g., any of RF power monitor circuit 502, impedance matching circuit 511, or telemetry circuit 503 of FIG. 5) or embedded coupler device 515 (of FIG. 5), information from the power harvesting (and parameter sensing) circuit 30*a* located within connector 100 or any other connectors along cable(s) 10. Another embodiment of a reader 400 may be an output signal 2 monitoring device located somewhere along the cable line to which the connector 100 is attached. For example, a physical parameter status may be reported through signal processing circuitry in electrical communication with the center conductor (e.g., center conductor 601 of FIG. 6) of the cable 10. Then the reported status may be monitored by an individual or a computer-directed program at the cable-line head end to evaluate the reported physical parameter status and help maintain connection performance. The connector 100 may ascertain connection conditions and may transmit physical parameter status information or an electrical parameter of an electrical signal automatically at regulated time intervals, or may transmit information when polled from a central location, such as the head end (CMTS), via a network using existing technology such as modems, taps, and cable boxes. A reader 400 may be located on a satellite operable to transmit signals to a connector 100. Alternatively, service technicians could request a status report and read sensed or stored physical parameter status information (or electrical parameter information) onsite at or near a connection location, through wireless hand devices, such as a reader 400*b*, or by direct terminal connections with the connector 100, such as by a reader 400*a*. Moreover, a service technician could monitor connection performance via transmission over the cable line through other common coaxial communication implements such as taps, set tops, and boxes.

Operation of a connector 100 can be altered through transmitted input signals 5 from the network or by signals transmitted onsite near a connector 100 connection. For example, a service technician may transmit a wireless input signal 4 from a reader 400*b*, wherein the wireless input signal 4 includes a command operable to initiate or modify functionality of the connector 100. The command of the wireless input signal 4 may be a directive that triggers governing protocol of a control logic unit to execute particular logic operations that control connector 100 functionality. The service technician, for instance, may utilize the reader 400*b* to command the connector 100, through a wireless input component, to presently sense a connection condition related to current moisture presence, if any, of the connection. Thus the control logic unit 32 may communicate with sensor, which in turn may sense a moisture condition of the connection. The power harvesting (and parameter sensing) circuit 30*a* could then report a real-time physical parameter status related to moisture presence of the connection by dispatching an output signal 2 through an output component (e.g., RF power monitor circuit 502) and back to the reader 400*b* located outside of the connector 100. The service technician, following receipt of the moisture monitoring report, could then transmit another input signal 4 communicating a command for the connector 100 to sense and report physical parameter status related to moisture content twice a day at regular intervals for the next six months. Later, an input signal 5 originating from the head end may be received through an input component in electrical communication with the center conductor contact 80 to modify the earlier command from the service technician. The later-received input signal 5 may include a command for the connector 100 to only report a physical parameter status pertaining to moisture once a day and then store the other moisture status report in memory 33 for a period of 20 days.

A coaxial cable connector connection system 1000 may include a reader 400 that is communicatively operable with devices other than a connector 100. The other devices may have greater memory storage capacity or processor capabilities than the connector 100 and may enhance communication of physical parameter status by the connector 100. For example, a reader 400 may also be configured to communicate with a coaxial communications device such as a receiving box 8. The receiving box 8, or other communications device, may include means for electromagnetic communication exchange with the reader 400. Moreover, the receiving box 8, may also include means for receiving and then processing and/or storing an output signal 2 from a connector 100, such as along a cable line. In a sense, the communications device, such as a receiving box 8, may be configured to function as a reader 400 being able to communicate with a connector 100. Hence, the reader-like communications device, such as a receiving box 8, can communicate with the connector 100 via transmissions received through an input component connected to the center conductor contact 80 of the connector. Additionally, embodiments of a reader-like device, such as a receiving box 8, may then communicate information received from a connector 100 to another reader 400. For instance, an output signal 2 may be transmitted from a connector 100 along a cable line to a reader-like receiving box 8 to which the connector is communicatively connected. Then the reader-like receiving box 8 may store physical parameter status information pertaining to the received output signal 2. Later a user may operate a reader 400 and communicate with the reader-like receiving box 8 sending a transmission 1002 to obtain stored physical parameter status information via a return transmission 1004.

Alternatively, a user may operate a reader 400 to command a reader-like device, such as a receiving box 8 communicatively connected to a connector 100, to further command the connector 100 to report a physical parameter status receivable by the reader-like receiving box 8 in the form of an output signal 2. Thus by sending a command transmission 1002 to the reader-like receiving box 8, a communicatively connected connector 100 may in turn provide an output signal 2 including physical parameter status information that may be forwarded by the reader-like receiving box 8 to the reader 400 via a transmission 1004. The coaxial communication device, such as a receiving box 8, may have an interface, such as an RF port 15, to which the connector 100 is coupled to form a connection therewith.

Referring to FIGS. 1-9 a coaxial cable connector power harvesting method is described. A coaxial cable connector 100 is provided. The coaxial cable connector 100 has a connector body 50 and a disk structure 40 located within the connector body 50. Moreover, a power harvesting (and parameter sensing) circuit 30*a* (e.g., comprising the: embedded metallic coupler device 515, impedance matching circuit 511, RF power harvesting circuit 529, RF power monitor circuit 502, telemetry circuit 503, and wire traces 515*a* of FIGS. 4 and 5) is provided, wherein the power harvesting (and parameter sensing) circuit 30*a* is housed within the disk structure 40. The power harvesting (and parameter sensing) circuit 30*a* has an embedded metallic coupler device 515 configured to harvest power from an RF signal flowing through the connector 100 when connected. In addition, a physical parameter output component (e.g., RF power monitor circuit 502, telemetry circuit 503, etc) is in communication with the power harvesting (and parameter sensing) circuit 30*a* to receive physical parameter status information. Further physical parameter status ascertainment methodology includes connecting the connector 100 to an interface, such as RF port 15, of another connection device, such as a receiving box 8, to form a connection. Once the connection is formed, physical parameter status information applicable to the connection may be reported, via a signal processing circuit, to facilitate conveyance of the physical parameter status of the connection to a location outside of the connector body 50.

Figure 10:
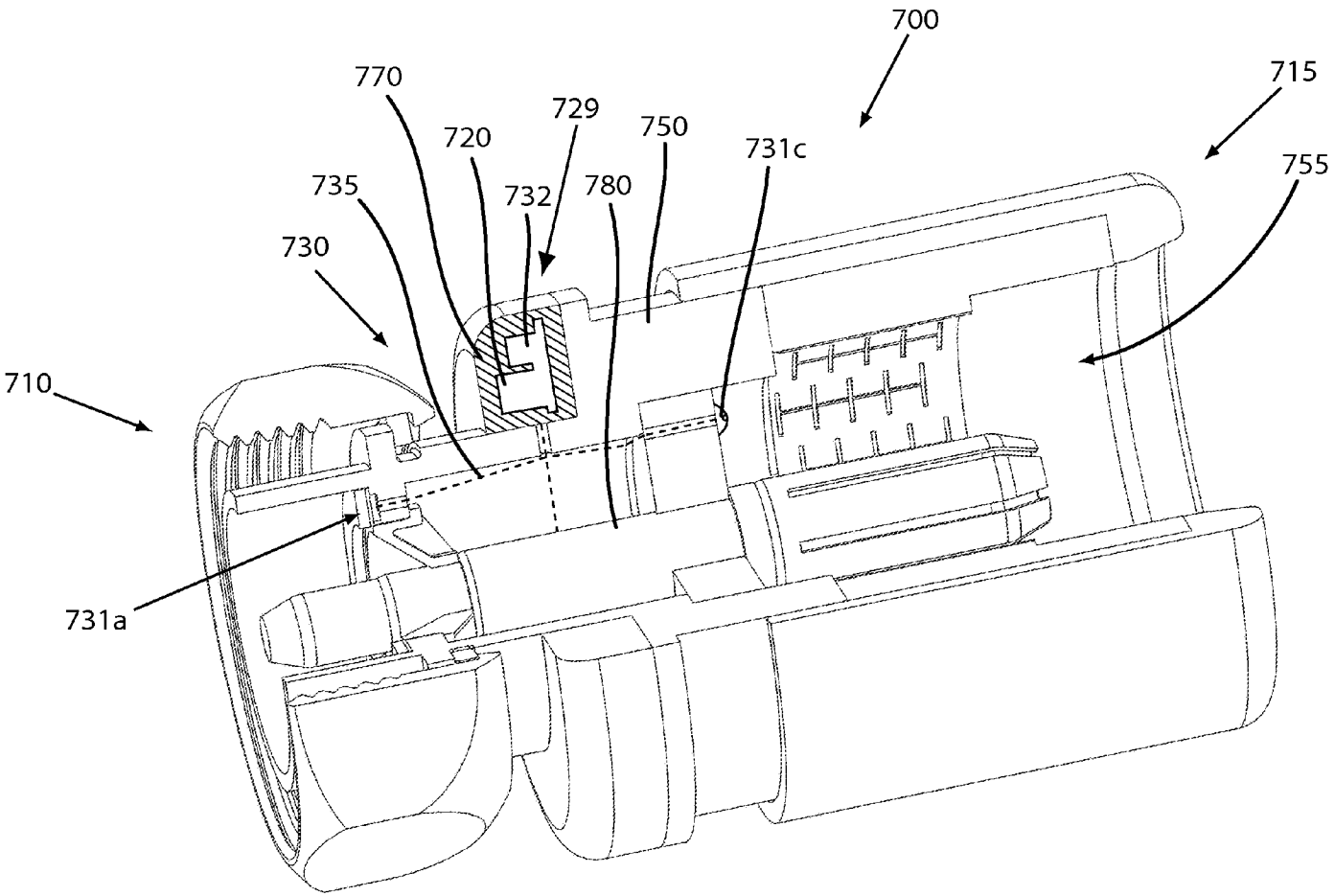
FIG. 10 depicts a side perspective cut-away view of another embodiment of a coaxial cable connector having multiple sensors, in accordance with the present invention.

Referring to the drawings, FIG. 10 depicts a side perspective cut-away view of an embodiment of a coaxial cable connector 700 having a coupler sensor 731*a* (e.g., the embedded metallic coupler device 515 of the internal power harvesting (and parameter sensing) circuit 30*a*) and a humidity sensor 731*c*. The connector 700 includes port connection end 710 and a cable connection end 715. In addition, the connector 700 includes sensing circuit 730*a* operable with the coupler sensor 731*a* and the humidity sensor or moisture sensor 731*c*. The coupler sensor 731*a* and the humidity sensor 731*c* may be connected to a processor control logic unit 732 operable with an output transmitter 720 through leads, traces, wires, or other electrical conduits depicted as dashed lines 735. The sensing circuit electrically links the coupler sensor 731*a* and the humidity sensor 731*c* to the processor control logic unit 732 and the output transmitter 729. For instance, the electrical conduits 735 may electrically tie various components, such as a processor control logic unit 732, sensors 731*a*, 731*c* and an inner conductor contact 780 together.

The processor control logic unit 732 and the output transmitter 720 may be housed within a weather-proof encasement 770 operable with a portion of the body 750 of the connector 700. The encasement 770 may be integral with the connector body portion 750 or may be separately joined thereto. The encasement 770 should be designed to protect the processor control logic unit 732 and the output transmitter 720 from potentially harmful or disruptive environmental conditions. The coupler sensor 731*a* and the humidity sensor 731*c* are connected via a sensing circuit 730*a* to the processor control logic unit 732 and the output transmitter 720.

The coupler sensor 731*a* is located at the port connection end 710 of the connector 700. When the connector 700 is mated to an interface port, such as port 15 shown in FIG. 9, a signal level of a signal (or samples of the signal) flowing through the connector 700 may be sensed by the coupler sensor 731*a*.

The humidity sensor 731*c* is located within a cavity 755 of the connector 700, wherein the cavity 755 extends from the cable connection end 715 of the connector 700. The moisture sensor 731*c* may be an impedance moisture sensor configured so that the presence of water vapor or liquid water that is in contact with the sensor 731*c* hinders a time-varying electric current flowing through the humidity sensor 731*c*. The humidity sensor 731*c* is in electrical communication with the processor control logic unit 732, which can read how much impedance is existent in the electrical communication. In addition, the humidity sensor 731*c* can be tuned so that the contact of the sensor with water vapor or liquid water, the greater the greater the measurable impedance. Thus, the humidity sensor 731*c* may detect a variable range or humidity and moisture presence corresponding to an associated range of impedance thereby. Accordingly, the humidity sensor 731*c* can detect the presence of humidity within the cavity 755 when a coaxial cable, such as cable 10 depicted in FIG. 9, is connected to the cable connection end 715 of the connector 700.

Power for the sensing circuit 730*a*, processor control unit 732, output transmitter 720, coupler sensor 731*a*, and/or the humidity sensor 731*c* of embodiments of the connector 700 depicted in FIG. 10 may be provided through electrical contact with the inner conductor contact 780 (using the aforementioned power harvesting process). For example, the electrical conduits 735 connected to the inner conductor contact 780 may facilitate the ability for various connector 700 components to draw power from the cable signal(s) passing through the inner connector contact 780. In addition, electrical conduits 735 may be formed and positioned so as to make contact with grounding components of the connector 700.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A structure comprising:

a disk structure located within a coaxial cable connector; and a signal retrieval circuit formed within the disk structure, wherein the signal retrieval circuit is located in a position that is external to a signal path of an electrical signal flowing through the coaxial cable connector, wherein the signal retrieval circuit is configured to extract an energy signal from the electrical signal flowing through the coaxial cable connector, and wherein the energy signal is configured to apply power to an electrical device located within the coaxial cable connector.

2. The structure of claim 1, further comprising a signal processing circuit mechanically attached to the disk structure, wherein the signal retrieval circuit is configured to sense an RF signal from the electrical signal flowing through the coaxial cable connector, and wherein the signal processing circuit is configured to report a sensed RF signal to a location external to the coaxial cable connector.

3. The structure of claim 2, wherein the energy signal is configured to apply power to the signal processing circuit.

4. The structure of claim 2, wherein the signal processing circuit is configured to report a level of the energy signal to said location external to the connector.

5. The structure of claim 1, wherein the electrical device located within the connector comprises a semiconductor device.

6. The structure of claim 5, wherein the semiconductor device is mechanically attached to the disk structure.

7. The structure of claim 1, wherein the disk structure comprises a syndiotactic polystyrene structure comprising a laser direct structuring (LDS) catalyst.

8. The structure of claim 1, wherein the signal retrieval circuit comprises a metallic structure formed within the disk structure.

9. The structure of claim 8, wherein the metallic structure is a loop coupling structure.

10. The structure of claim 9, wherein the loop coupling structure is an antenna.

11. The structure of claim 8, wherein the metallic structure comprises a first cylindrical structure and a second adjacent cylindrical extending from a bottom surface of the disk structure through a top surface of the disk structure, and wherein the first cylindrical structure in combination with the second cylindrical structure is configured to apply the power to the electrical device located within the coaxial cable connector.

12. The structure of claim 1, wherein the electrical device located within the connector comprises a sensor device configured to sense a condition of the coaxial cable connector when connected to an RF port.

13. The structure of claim 1, wherein the energy signal comprises a voltage signal.

14. A structure comprising:

a first metallic structure formed within a disk structure, wherein the disk structure is located within a coaxial cable connector, wherein the first metallic structure is located in a position that is external to a signal path of an electrical signal flowing through the coaxial cable connector; and a second metallic structure formed within the disk structure, wherein the second metallic coupler structure is located in a position that is external to the signal path of the electrical signal flowing through the coaxial cable connector, and wherein the first metallic structure in combination with the second metallic structure is configured to extract an energy signal from the electrical signal flowing through the coaxial cable connector, and wherein the energy signal is configured to apply power to an electrical device located within the coaxial cable connector.

15. The structure of claim 14, wherein the first metallic structure comprises a first cylindrical structure extending from a bottom surface of the disk structure through a top surface of the disk structure, wherein the second metallic structure comprises a second cylindrical structure extending from the bottom surface of the disk structure through the top surface of the disk structure, and wherein the first cylindrical structure in combination with the second cylindrical structure is configured to apply the power to the electrical device located within the coaxial cable connector.

16. The structure of claim 14, wherein the first metallic structure in combination with the second metallic structure form a loop coupler.

17. The structure of claim 14, wherein the electrical device comprises a semiconductor device.

18. A structure comprising:

a metallic signal retrieval circuit formed within a disk structure located within a coaxial cable connector, wherein the metallic circuit is located in a position that is external to a signal path of an electrical signal flowing through the coaxial cable connector, wherein the metallic signal retrieval circuit is configured to extract an energy signal from the electrical signal flowing through the coaxial cable connector; and an electrical device mechanically attached to the disk structure, wherein the energy signal is configured to apply power to the electrical device.

19. The structure of claim 18, wherein the metallic signal retrieval circuit comprises a first cylindrical structure extending from a bottom surface of the disk structure through a top surface of the disk structure and a second cylindrical structure extending from the bottom surface of the disk structure through the top surface of the disk structure, and wherein the first cylindrical structure in combination with the second cylindrical structure is configured to apply the power to the electrical device.

20. The structure of claim 18, wherein the metallic signal retrieval circuit is a loop coupler.

21. The structure of claim 18, wherein the electrical device comprises a semiconductor device.

22. A method comprising:

providing a signal retrieval circuit formed within the disk structure located within a coaxial cable connector, wherein the signal retrieval circuit is located in a position that is external to a signal path of an electrical signal flowing through the coaxial cable connector;

extracting, by the signal retrieval circuit, an energy signal from the electrical signal flowing through the coaxial cable connector; and supplying, by the energy signal, power to an electrical device located within the coaxial cable connector.

23. The method of claim 22, further comprising;

providing a signal processing circuit mechanically attached to the disk structure;

sensing, by the signal retrieval circuit, an RF signal from the electrical signal flowing through the coaxial cable connector; and reporting, by the status output component, the sensed RF signal to a location external to the coaxial cable connector.

24. The method of claim 23, further comprising:

applying, by the energy signal, power to the signal processing circuit.

25. The method of claim 23, further comprising:

reporting, by the signal processing circuit, the sensed RF signal via a wireless output signal transmission.

26. The method of claim 23, further comprising:

reporting, by the status output component, a level of the energy signal to the location external to the coaxial cable connector.

27. The method of claim 22, wherein the electrical device located within the connector comprises a semiconductor device.

28. The method of claim 22, wherein the signal retrieval circuit comprises a metallic structure formed within the disk structure.

29. The method of claim 28, wherein the metallic structure is coupler.

30. The method of claim 22, wherein the energy signal comprises a voltage signal.

* * * * *